US010017904B2

(12) United States Patent
Richins

(10) Patent No.: US 10,017,904 B2
(45) Date of Patent: Jul. 10, 2018

(54) TEMPORARY TURF MARKING SYSTEM

(71) Applicant: David A. Richins, American Fork, UT (US)

(72) Inventor: David A. Richins, American Fork, UT (US)

( * ) Notice: Subject to any disclaimer, the term of this patent is extended or adjusted under 35 U.S.C. 154(b) by 1 day.

(21) Appl. No.: 14/951,404

(22) Filed: Nov. 24, 2015

(65) Prior Publication Data

US 2016/0144262 A1 May 26, 2016

Related U.S. Application Data

(60) Provisional application No. 62/084,255, filed on Nov. 25, 2014.

(51) Int. Cl.
*E01C 13/00* (2006.01)
*A63C 19/06* (2006.01)

(52) U.S. Cl.
CPC ..... *E01C 13/00* (2013.01); *A63C 19/065* (2013.01); *A63C 2019/067* (2013.01)

(58) Field of Classification Search
USPC ..... 118/323, 313–315, 303; 222/162, 174; 111/11, 188; 239/156
See application file for complete search history.

(56) References Cited

U.S. PATENT DOCUMENTS 3,817,644 A * 6/1974 Matson ..... B28B 1/093 404/114
3,822,655 A * 7/1974 Benedict ..... A01G 1/12 111/11
3,995,569 A * 12/1976 Picardat ..... A01B 45/00 111/118
4,273,264 A * 6/1981 Legg ..... A01B 69/022 111/33
4,798,325 A * 1/1989 Block ..... A01M 11/00 239/156
2009/0052986 A1* 2/2009 Hall ..... E01C 23/065 404/90

* cited by examiner

*Primary Examiner* — Yewebdar T Tadesse
(74) *Attorney, Agent, or Firm* — Morriss O'Bryant Compagni Cannon, PLLC

(57) ABSTRACT

A temporary turf marking system is disclosed. The temporary turf marking system includes a material spreader, the material spreader having a foam dispenser fixed thereto. A dispenser actuator actuates the foam dispenser, such that foam is dispensed from the dispenser onto the turf, forming a foam trail.

9 Claims, 14 Drawing Sheets

DETAIL A

DETAIL C

SECTION B-B

RIGHT POSITION

ISOMETRIC OF
RIGHT POSITION

CENTER POSITION

LEFT POSITION

TEMPORARY TURF MARKING SYSTEM

CROSS-REFERENCE TO RELATED APPLICATION

This application claims the benefit of U.S. Provisional Application No. 62/084,255, filed Nov. 25, 2014, which is hereby incorporated by reference herein in its entirety, including but not limited to those portions that specifically appear hereinafter, the incorporation by reference being made with the following exception: in the event that any portion of the above-referenced application is inconsistent with this application, this application superceded said above-referenced application.

BACKGROUND

1. The Field of the Present Disclosure

This present disclosure relates generally to the field of landscaping spreaders used for spreading seeding, fertilizers or other desired materials onto a grass turf.

2. Description of Related Art

Typically, when material is dropped on grass turf from a machine like a fertilizer spreader, the fertilizer tends to disappear into the grass without leaving a visible trace on the turf to help an operator determine which areas have already been covered by the dropped material.

Often, fertilizer or other material is applied to the grass turf after the grass has been cut, which can leave many wheel tracks from both a mower and the spreader on the grass surface, making it very difficult, if not impossible, for the operator to distinguish which wheel tracks are from the mower and which marks are from the spreader.

This confusion over wheel tracks can lead to some areas of the turf being applied with too much fertilizer and other areas being completely missed. This can result in a turf that has stripes or inconsistencies in texture and color, depending on which areas were fertilized and which areas were not.

The problem is providing consistent and even coverage of spreading material, particularly while using a spreader, is not unique for fertilizer application, but is also needed for applications for weed and bug control, etc.

Equipment for marking lawns or turf for sporting events has been around for a long time. This equipment has used paint, lime, liquid chalk, etc. for marking borders or boundaries. These machines have marked the field typically with a quasi-permanent marker or line so that the lines remain visible during the complete sporting event or for multiple events. However, this type of marking would not be suitable for lawn marking, where fertilizer has been applied because of the quasi-permanent nature of the marking. This quasi-permanent marking would detract immensely from the beauty and aesthetics of the lawn or turf.

In order to overcome these problems, the disclosed temporary marking system can deposit or mark the surface of a grass turf or lawn, such that the mark gives a visual cue to the operator to be able to identify where material has already been applied. The disclosed marker or visual cue can be temporary, so that the marker would not be visible after a few short minutes, but be visible long enough to deposit the fertilizer or other desired material.

The features and advantages of the present disclosure will be set forth in the description which follows, and in part will be apparent from the description, or may be learned by the practice of the present disclosure without undue experimentation. The features and advantages of the present disclosure may be realized and obtained by means of the instruments and combinations particularly pointed out herein.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
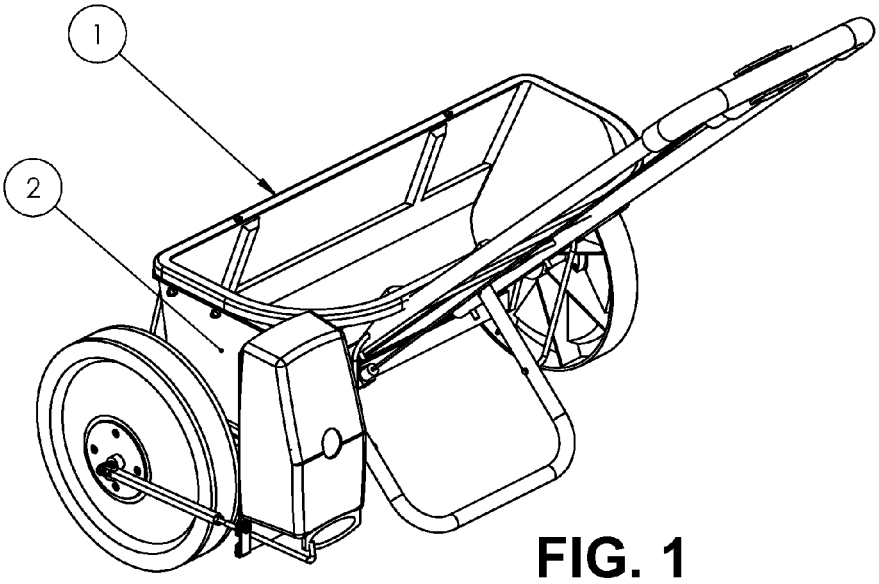
FIG. 1 is a perspective view of an embodiment of a temporary turf marking system of the present disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

It must be noted that, as used in this specification and the appended claims, the singular forms "a," "an," and "the" include plural referents unless the context clearly dictates otherwise.

In describing and claiming the present disclosure, the following terminology will be used in accordance with the definitions set out below.

As used herein, the terms "comprising," "including," "containing," "characterized by," and grammatical equivalents thereof are inclusive or open-ended terms that do not exclude additional, unrecited elements or method steps.

Applicant has discovered a novel system, apparatus and method for temporarily marking grass turf with a material spreader. The disclosed system, method and apparatus provides a temporary marking system that produces a visible mark where a material or fertilizer spreader has dropped the corresponding material. The disclosed marking system dispenses a series of discrete portions of soap foam, or other desired foam marker, such that the discrete portions of foam are deposited onto a lawn or turf surface. The foam or foam marker can also include, for example shaving cream, foamed milk or any other foam or foam-like material that may be visible for a limited time duration and then dissipate from view. Additionally, the foam marker may also include other materials that may be visible for only a limited duration, such as powder-like material. The foam remains visible on the surface of the turf for an amount of time sufficient to allow a user or operator to complete another pass of spreader (in an opposition direction), and then the foam disappears.

Experimentation has shown that foam can be light enough to sit on top and remain on top of the turf or grass. The foam can take about 5 to 10 minutes to dissipate or disappear, so that it can no longer be seen on the grass. The amount of soap required in a soap-water solution to make foam is very small, which has the added benefit of making the foam more environmentally compatible and less damaging or potentially damaging to the turf.

The foam dispensing may be continuous, although a continuous stream of foam is not needed to adequately mark the turf. Efficient foam deposition onto the turf, for the purpose of aiding in the tracking or guiding of the fertilizer or material application can be dispensed in discrete amounts spaced between 3 to 6 feet apart, or at another desired interval. By spacing the foam at these intervals, a marking system for a 10,000 square foot lawn can be accomplished with approximately one liter or one quart of a foam soap solution which makes the system more cost effective and environmentally safe.

The foam marker can be dispensed by a mark or foam dispenser which is positioned on the spreader such that the foam is dispensed behind the spreader during use. The dispenser can also be positioned on the spreader such that the dispensed foam can indicate to the operator where to align the spreader for a next pass of the spreader, ensuring proper coverage of the desired material or fertilizer, without inadvertently missing or overlapping sections of lawn or turf.

As a first example, if the foam dispenser is positioned to deposit the foam marker directly behind, or inline with, a wheel of the spreader, the operator can then use the manufacturer's provided alignment markings on the spreader to align with the deposited foam marker. In a second example, the foam dispenser can be positioned to deposit the foam marker directly behind the manufacturer's provided alignment markings on the spreader, and the operator can then align the wheel of the spreader with the deposited form marker. Either, or both, of these examples can enable the operator to ensure ample proper coverage of the desired spreading material without missing portions of turf or excessively overlapping spreading material.

This foam marker configuration and dispensing prevents the foam from transferring any moisture to a drop mechanism of the spreader which would cause the material or fertilizer to clump and evenly distribute. This configuration also facilitates a slight, but desirable, overlap for the material or fertilizer on each pass. Alternatively, the foam marker dispenser could deposit foam in the middle of the spreader, for example on a broadcast or orbital-type spreader. Conventional broadcast spreaders often recommend a 5 to 7 foot spacing between passes.

In the disclosed embodiments, the foam dispenser can combine a solution of soap and water with air to produce the foam. The foam dispenser is configured to provide or enable rapid or repeated discrete distributions of foam.

The disclosed method of temporarily marking turf includes providing a temporary marking system where discrete and intermittent foam marks can be dispensed onto a turf surface manually, mechanically, or electronically. A manual marking system can include a user holding a foam dispenser and manually activating the dispenser in intermittent sequence dispensing foam behind a wheel of a spreader or in the middle of the spreader, or mounting a foam dispenser to a spreader and then running a cable actuator (similar to a cable actuator used to control a throttle on a lawn mower) to the dispenser and then intermittently activating the dispenser by initiating the actuator, dispensing foam onto the turf. The frequency or intervals of dispensing the foam may be modified or customized according to the discretion of the operator.

Figure 2:
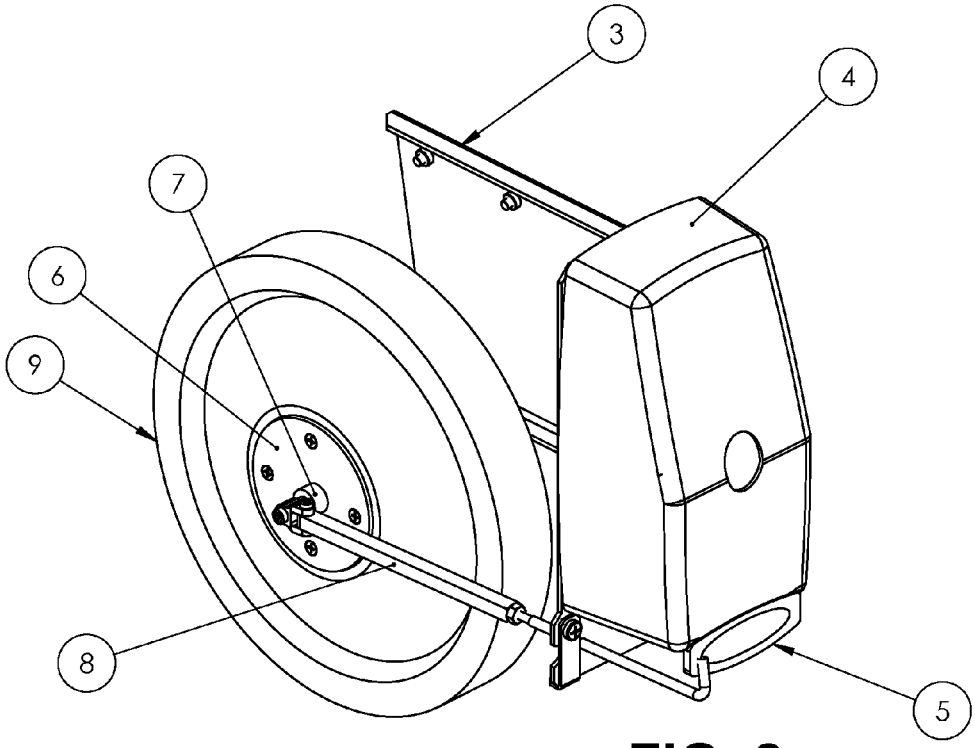
FIG. 2 is a zoomed-in perspective view of the actuation device of the embodiment of FIG. 1.
Figure 3:
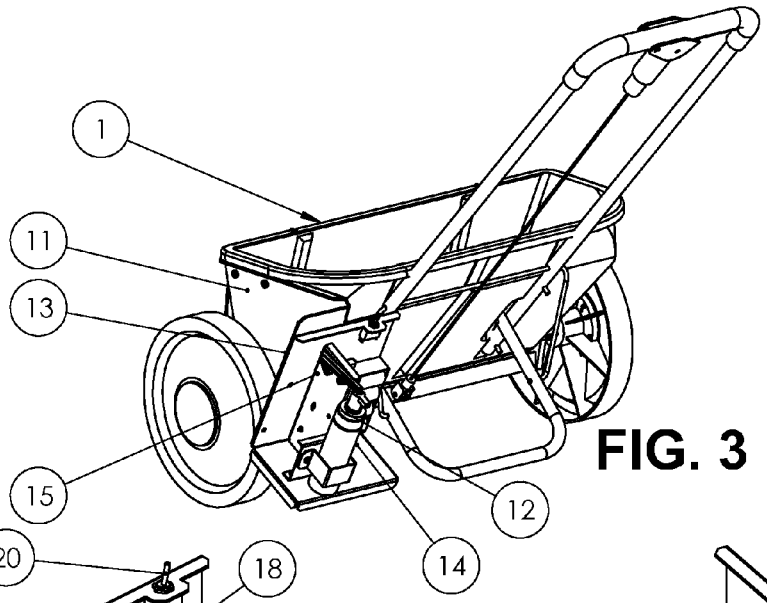
FIG. 3 is a perspective view of another embodiment of a temporary turf marking system of the present disclosure.
Figure 4:
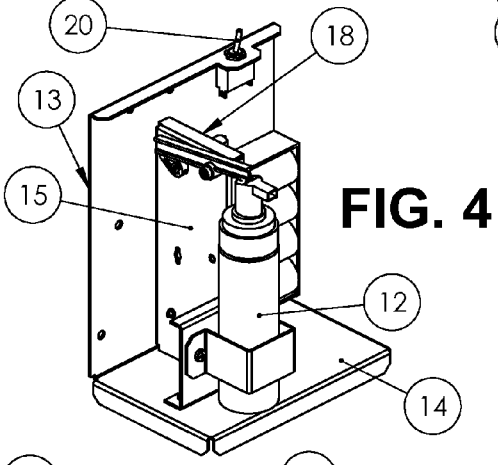
FIG. 4 is a zoomed-in perspective view of the actuation device of the embodiment of FIG. 3.

FIGS. 1 and 2 illustrate an embodiment of the disclosed temporary turf marking system. Disclosed is a commercially available manual spreader 1, which can be used as a drop spreader, dispensing material, such as fertilizer, directly beneath the spreader 1. A conventional spreader often includes a bucket or container that stores the desired material (to be dropped/spread), with the bucket including an opening or openings that can be opened or closed by the user to facilitate a desired amount of dropped/spread material. The spreader 1 can be pushed manually by a user as a user walks behind the spreader 1, or alternatively, a spreader can be powered similar to a ride-on lawnmower or the like. A foam or marking dispenser assembly 2 can be mounted to the spreader 1.

The foam dispenser assembly 2 can be mounted to the spreader 1 via a bracket 3. The bracket 3 can be fixed to a side of the spreader 1, or alternatively, the bracket 3 can be attached to the back of the spreader 1, an operator handle, or to a stand of the spreader 1. A foam dispenser 4 is mounted and fixed to the bracket 3. The foam dispenser 4 includes a pump actuator 5, used to dispense foam within the dispenser 4. Different foam soap dispensers could also be used, for example, a top discharge or bottom discharge dispenser, using a foam container utilizing a bag or bottle (not shown). Additionally, the foam dispenser 4 may be refillable, permitting a user to refill the foam dispenser 4 at any desired time during, before, or after use.

A mechanical cam 6 can be mounted to a wheel 9 of the spreader 1. The spreader 1 includes at least 2 wheels 9, but could also include additions wheel in other configurations not shown in the figures. The cam 6 can be any number of profiles, but disclosed cam 6 has a circular profile. An actuator arm 8 can be attached to the cam 6 in a non-concentric position via a bushing or joint 7. As the wheel 9 rotates, a reciprocating motion is provided to the actuator arm 8. By controlling the mounting point of the actuator arm 8 with respect to the center of the wheel 9, the amount of travel for the actuator arm 8 can be defined. The actuator arm 8 is positioned through an opening in the mounting bracket 3 and actuates the pump actuator 5.

As the actuator arm 8 moves the pump actuator 5, foam is discharged out the bottom of the dispenser 4 and onto a lawn or turf surface. The distance between discrete portions of foam on the turf can be defined by the diameter of the wheel 9 on the spreader 1. Alternatively, a separate wheel with a different diameter could be used to reciprocate the actuator arm 8, or a gearing system could also be used to vary the distance between the discrete foam portions.

FIGS. 3-7 show an electronic automated foam dispensing system. A bracket 11 can be attached to the spreader 1. The bracket 11 is used to mount a foam dispenser 12 to the spreader 1. Brackets 13 and 14 are used to add additional support to the foam dispenser 12. Bracket 15 provides mounting for a motor 16, a cam 17, and a cam follower 18, to the spreader 1. A battery pack 19, which is also mounted to bracket 15, can provide power to the motor 16. An electrical switch 20 is electrically configured to turn the motor 16 on and off.

When the switch 20 is turned on, the motor 16 automatically and continuously rotates. The cam 17, which is mechanically engaged to the motor 16 rotates with the motor 16. The shape and design of the cam 17 can be varied to suit the designer, but for this configuration, the cam 17 is a fast rise design to minimize the time to actuate the dispenser 12 and elongate the dwell time for the dispenser 12. A disadvantage of a cycloid cam (circular cam with offset) is that the cycloid cam may not actuate the dispenser 12 fast enough and the foam may not dispense in even, discrete portions, but instead barely come out of the nozzle and deposit onto the bottle instead of clearing the bottle and depositing on the lawn or turf.

The amount of offset in the cam 17 determines the amount of lift or cam travel. With the cam 17 rotating, the cam follower 18 follows the profile of the cam 17. The cam follower 18 pivots about a bearing surface 21. As the cam 17 rotates, the cam follower 18 moves up and down. As the cam follower 18 moves up and down, the pump 22 of the dispenser 12, is pushed up and down, thus activating the dispenser 12 and discharging foam through the dispenser nozzle 23 and onto the grass or turf.

The dispensing or application route for spreading the material or fertilizer can vary between operators. Some operators may prefer to go around the lawn or turf in the same direction, while others may prefer to go in straight line segments such as back and forth. The above disclosed turf marking system can accommodate someone that desires to go around the lawn in the same direction; however, it would not accommodate someone who desires to go back and forth, due to the dispenser 12 being located on the left side of the spreader 1.

Figure 8:
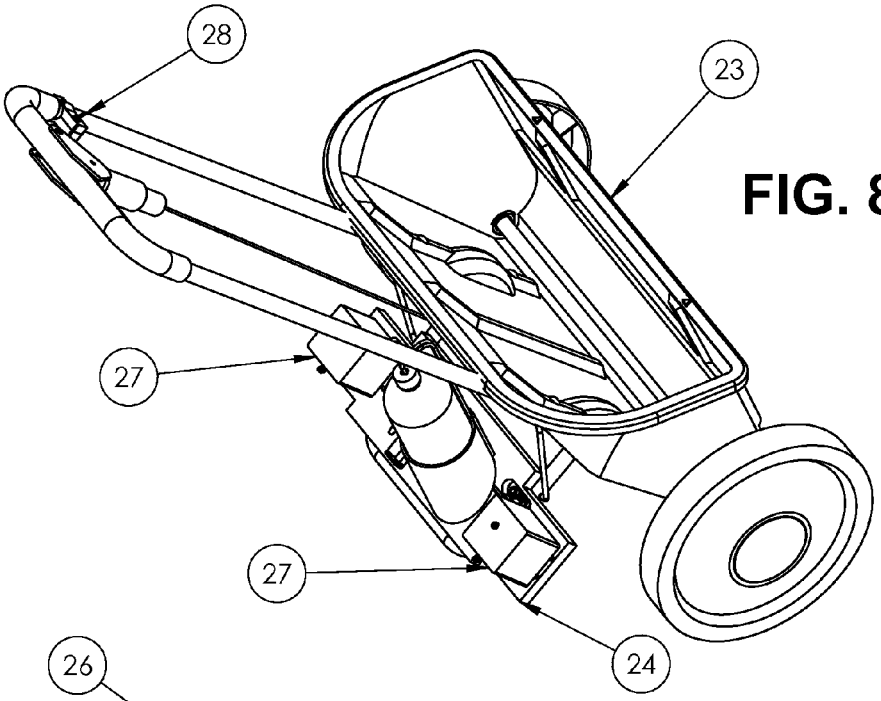
FIG. 8 is a perspective view of another embodiment of a temporary turf marking system of the present disclosure.
Figure 9:
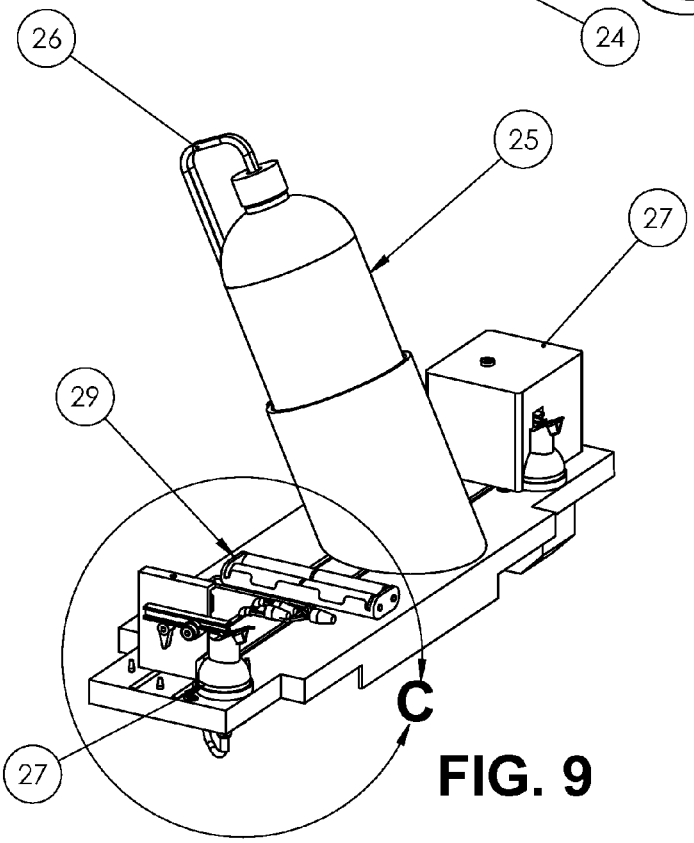
FIG. 9 is a perspective view of the mark dispensing components of the embodiment of FIG. 8.
Figure 10:
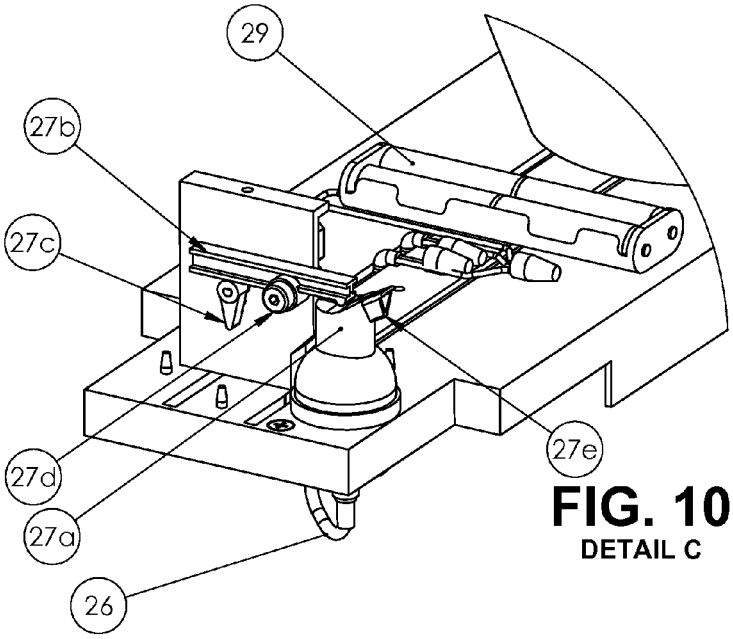
FIG. 10 is a zoomed-in perspective view of the actuation device of the embodiment of FIG. 8.

The embodiment shown in FIGS. 8-10 discloses temporary turf marking system that accommodates someone who desires to use a spreader in a back and forth-type route. FIG. 8 discloses a spreader 23 with a dual foam dispensing system 24 attached to the spreader 23. FIG. 10 is a zoomed-in view of the foam dispensing system 24. The foam dispensing system 24 includes a reservoir 25, used to store foam solution. Tubes 26 are used to deliver the foam solution to corresponding foam dispensing assemblies 27.

There are two foam dispensers 27*a*, one in each foam dispensing assembly 27, each fixed on opposite sides of the system 24. A cover for the foam assembly 27 on the near side has been removed to show the moving parts. Electrical power for actuating the foam dispensers 27*a* is provided by the battery pack 29. A toggle switch 28 is mounted on a handle of the spreader 23 so that an operator can control the power provided to the foam dispenser 27*a* either on the right side of the left side. A center position on the toggle switch 28 is provided to turn off power to both dispensers 27*a*.

A tube 26 supplies the foam solution from the reservoir 25 to the corresponding foam dispensers 27*a*. The dispensers 27*a* are actuated by a cam follower 27*b* that is driven by a cam 27*c* which is driven by an electric motor, similar to motor 16 in FIG. 5. The cam follower 27*b* rotates about a shaft on a shoulder screw 27*d*. As the cam 27*c* rotates, the cam follower 27*b* moves up and down which moves the foam dispenser 27*a* up and down, thus actuating the dispenser and delivering foam out of the foam dispenser nozzle 27*e*.

Figure 11:
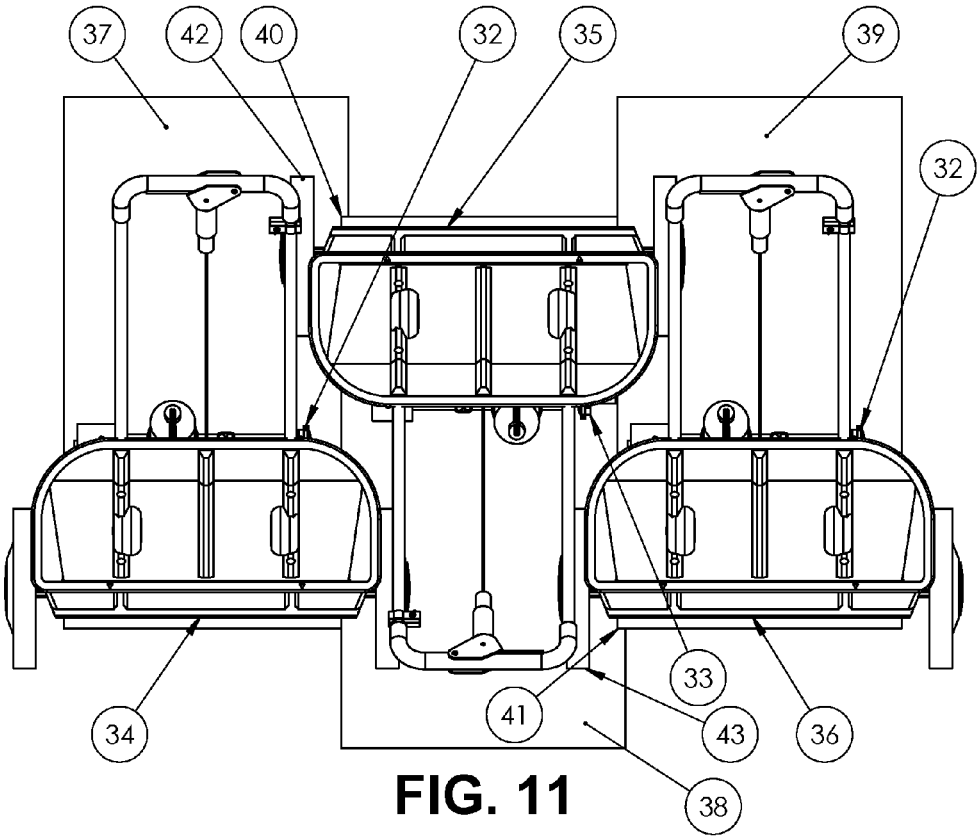
FIG. 11 is a top view of the marking path of a turf marking system of the present disclosure.
Figure 13:
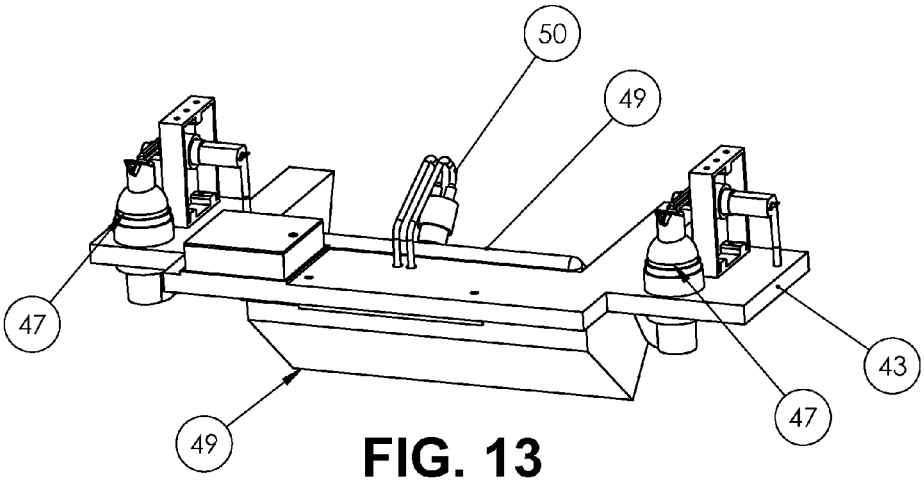
FIG. 13 is a perspective view of the mark dispensing components of the embodiment of FIG. 12.
Figure 12:
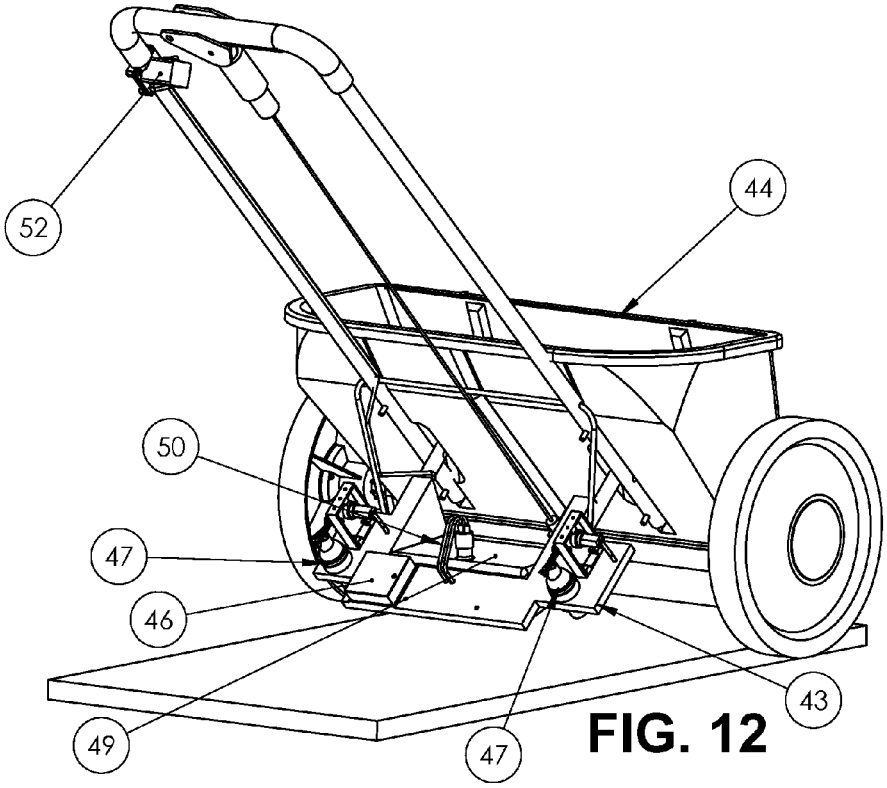
FIG. 12 is a perspective view of another embodiment of a temporary turf marking system of the present disclosure.
Figure 14:
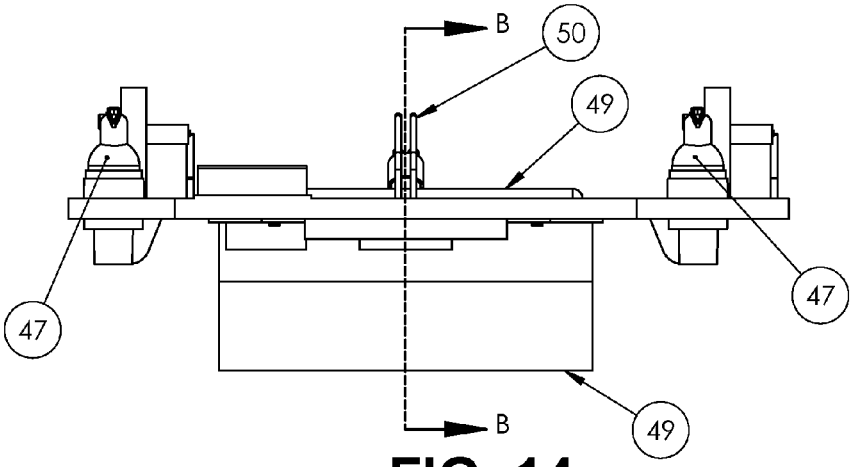
FIG. 14 is a front view of the mark dispensing components of the embodiment of FIG. 12.
Figure 15:
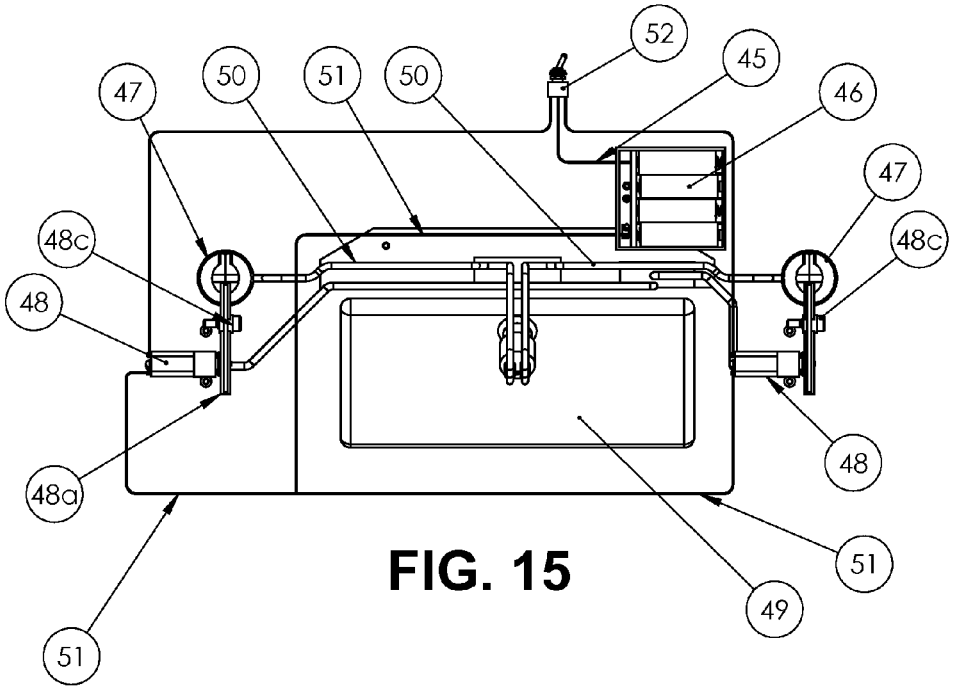
FIG. 15 is a top view of a schematic illustration of the perspective the mark dispensing components of the embodiment of FIG. 12.

FIG. 11 illustrates a top view of three spreaders 34, 35 and 36. The spreader 34 is moving towards the bottom of the page. The spreader 35 is moving towards the top of the page, and the spreader 36 also moving towards the bottom of the page. A fertilizer path 37 shows the drop path of spreader 34. Fertilizer path 38 shows the drop path of spreader 35. And fertilizer path 39 shows the drop path of spreader 36. The purpose of this view is to show a back and forth application of material or fertilizer. Assume that the application of the fertilizer is from left to right. The first spreader pass 34 would have the left foam dispenser 32 activated. The next pass represented by spreader 35 could have the right foam dispenser 33 activated. The next pass represent by spreader 36 would have the left foam dispenser activated 32.

FIG. 11 also shows how an operator can align the spreaders 34, 35 and 36 for additional passes to ensure that there is a slight overlap of the material or fertilizer from each pass. When spreader 34 drops fertilizer, represented by path 37, there is a foam trail provided by the dispenser 32. On the return pass by spreader 35, the operator can line up a wheel 42 of spreader 35 with the foam dispensed from foam dispenser 32. This alignment can provide an overlap 40. On the next return pass, the operator uses the wheel 43 of the spreader 36 to align to the foam dispensed by the foam dispenser 33, providing a slight overlap 41.

In some configurations, when foam solution is stored above a dispenser, the foam solution may tend to siphon through the dispenser when the motor and actuator are turned off. To prevent this siphoning, the container or reservoir for can be located even with, or below the corresponding dispenser or dispensers.

FIGS. 12-16 disclose another embodiment of the temporary turf marking system that positions a foam solution reservoir below corresponding foam dispensers, thus preventing the solution from siphoning through the dispensers.

The embodiment shown in FIGS. 12-16 discloses a spreader 44 with a dual foam dispensing system 43 attached to the spreader 44. The foam dispensing system 44 includes a reservoir 49, used to store foam solution. Tubes 50 are used to deliver the foam solution to corresponding foam dispensers 47. There are two foam dispensers 47 in the soap dispensing system 43, each fixed on opposite sides of the system 43. Electrical power for actuating the foam dispensers 47 is provided by the battery pack 46 through electrical connection 45. A toggle switch 52 is mounted on a handle of the spreader 44 so that an operator can control the power provided to the foam dispenser 47 either on the right side of the left side. A center position on the toggle switch 52 is provided to turn off power to both dispensers 47.

Figure 5:
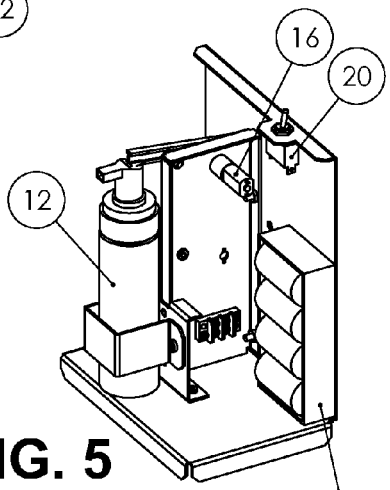
FIG. 5 is a zoomed-in perspective side view of the actuation device of the embodiment of FIG. 3.
Figure 6:
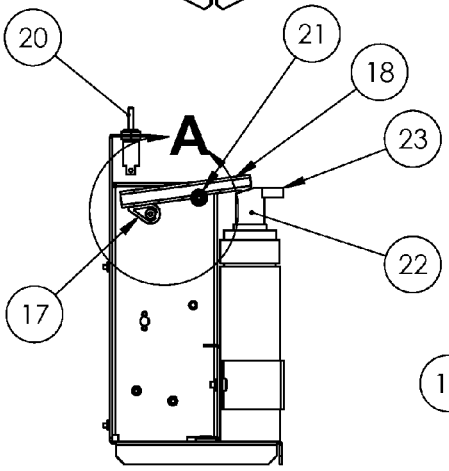
FIG. 6 is a cross-sectional view of the actuation device of the embodiment of FIG. 3.
Figure 7:
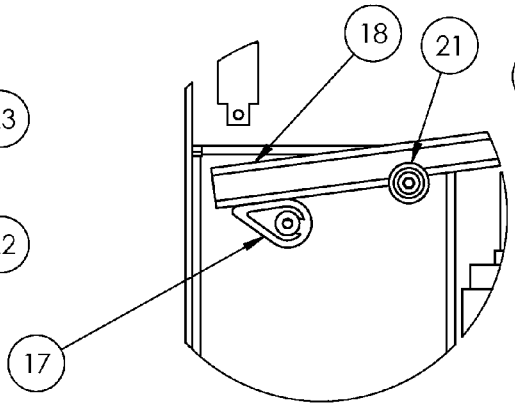
FIG. 7 is a zoomed-in cross-sectional view of the actuation device of the embodiment of FIGS. 4-6.

The dispensers 47 are actuated by a cam actuation device 48 that includes a cam follower 48 that is driven by a cam 48*b* which is driven by an electric motor similar to motor 16 in FIG. 5. The cam follower 48*a* rotates about a shaft on a shoulder screw 48*c*. As the cam 48*b* rotates, the cam follower 48*a* moves up and down which moves the foam dispenser 47 up and down, thus actuating the dispenser 47 and delivering foam out of the foam dispenser nozzle 31.

Figure 16:
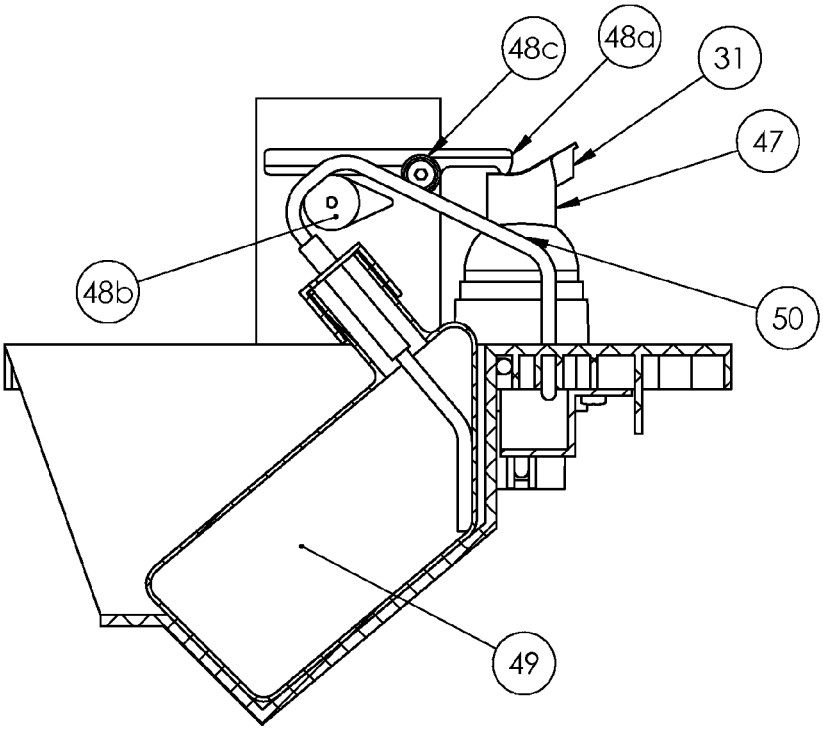
FIG. 16 is a cross-section view of the mark dispensing components of the embodiment of FIG. 12.

As shown in FIG. 16, the reservoir 49 is located substantially below the dispenser 47 which prevents, or significantly reduces, siphoning from the dispenser 47.

Figure 17:
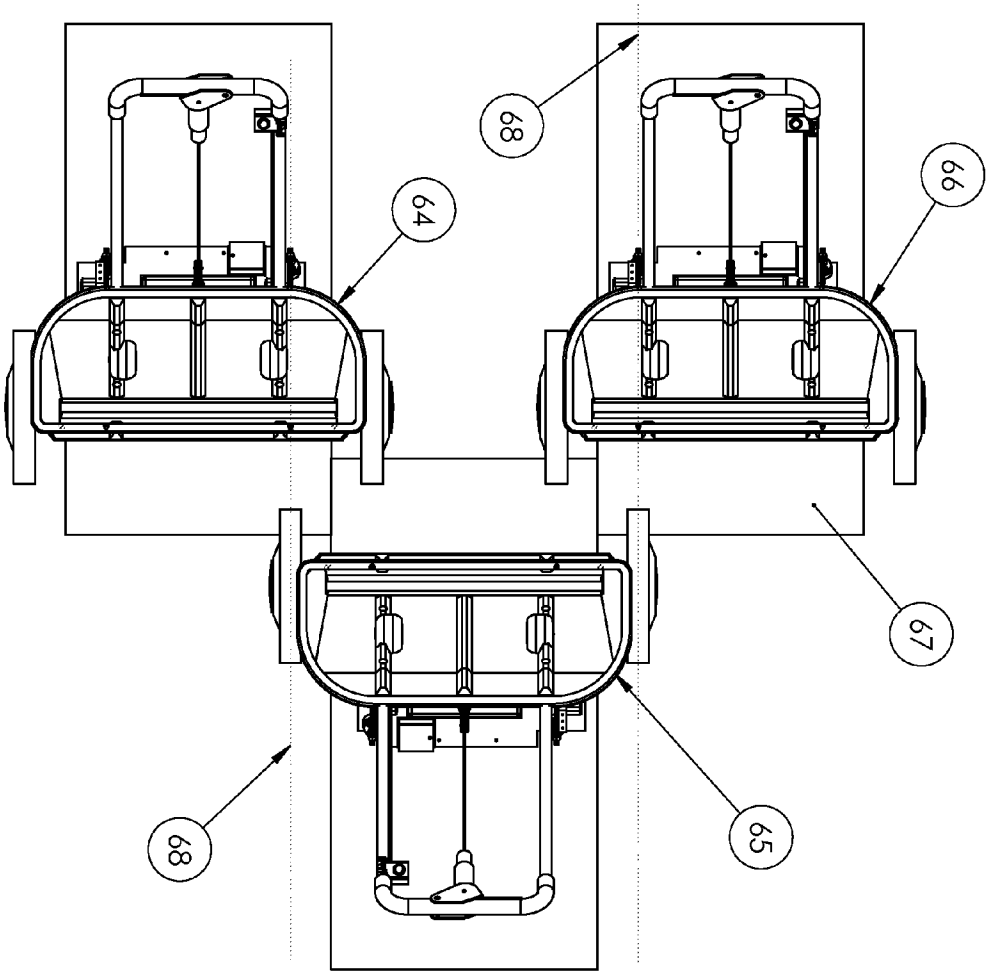
FIG. 17 is a top view of the marking path of a turf marking system of the present disclosure.

FIG. 17 illustrates how an operator can align spreader operating paths, using spreaders similar to, or the same, as those in embodiments discussed above. Spreaders 64, 65 and 66 can be operated to ensure that there is a slight overlap of the material or fertilizer from each pass. When spreader 64 drops fertilizer, represented by path 67, there is a foam trail 68 provided by a corresponding dispenser. On the return pass by spreader 65, the operator can line up a wheel of spreader 65 with the foam trail from the corresponding foam dispenser. This alignment can provide an overlap. On the next return pass, the operator uses the wheel of the spreader 66 to align to the foam trail 68 by the corresponding dispenser, providing another slight overlap.

Figure 18:
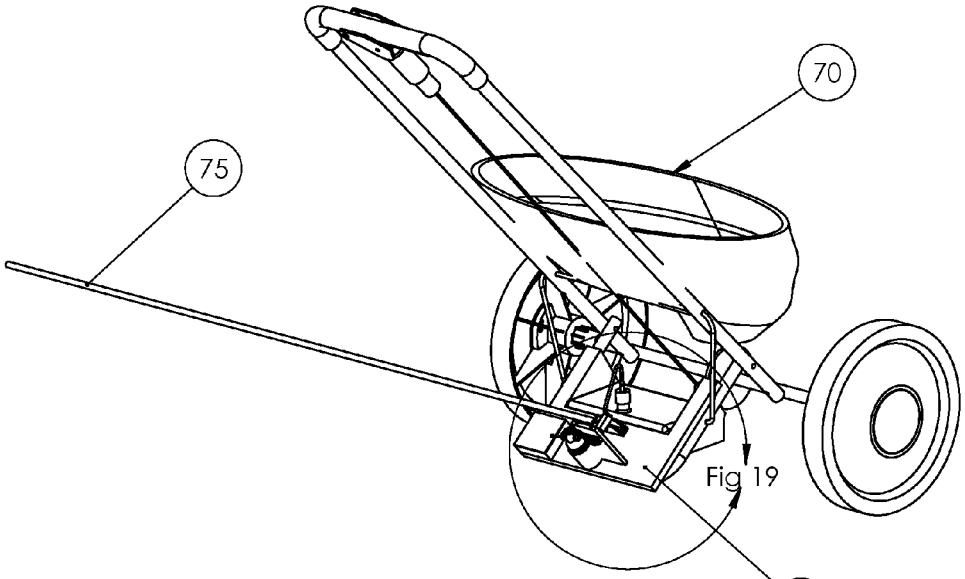
FIG. 18 is a perspective view of another embodiment of a temporary turf marking system of the present disclosure.
Figure 19:
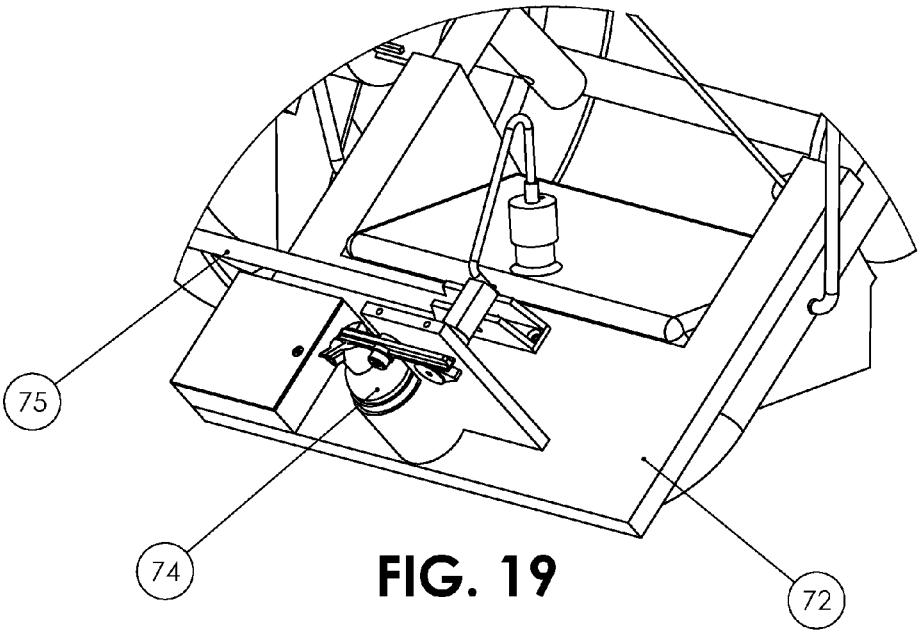
FIG. 19 is a zoomed-in perspective view of the actuation device of the embodiment of FIG. 18.

The embodiment shown in FIGS. 18-19 discloses a spreader 70 having a foam dispensing system 72 attached to the spreader 70. The spreader 70 may be a broadcast or orbital spreader, which radiates the spreading material beyond the immediate footprint of the spreader 70. The foam dispensing system 72 includes a foam dispenser 74 similar in structure and function to the foam dispenser 27*a*, shown in FIG. 10, including a similar dispenser actuator and reservoir.

However, as opposed to the embodiment shown in FIG. 10, the foam dispensing system 72 includes only a single foam dispenser 74, and the foam dispenser 74 is located along a centerline of the spreader 70, as opposed to being located on a left or right side of the spreader 70 which would be off-centered with respect to the spreader. An alignment rod 75 is also fixed to the spreader 70 substantially along a centerline of the spreader 70. The alignment rod 76 can be hinged to the spreader 70 such that the alignment rod can pivot from right to left. The end of the alignments rod 75 can be used to align with the foam trail provided by the foam dispenser 74 during use. The length of the alignment rod 7 can compensate for the expanded material dispersement area generated by the broadcast spreader 70. The pivotablility of the alignment rod 76 also allows the user to make right or left turns while still utilizing the alignments rod 75 to ensure proper coverage of the material being dispersed by the spreader 70.

Figure 20:
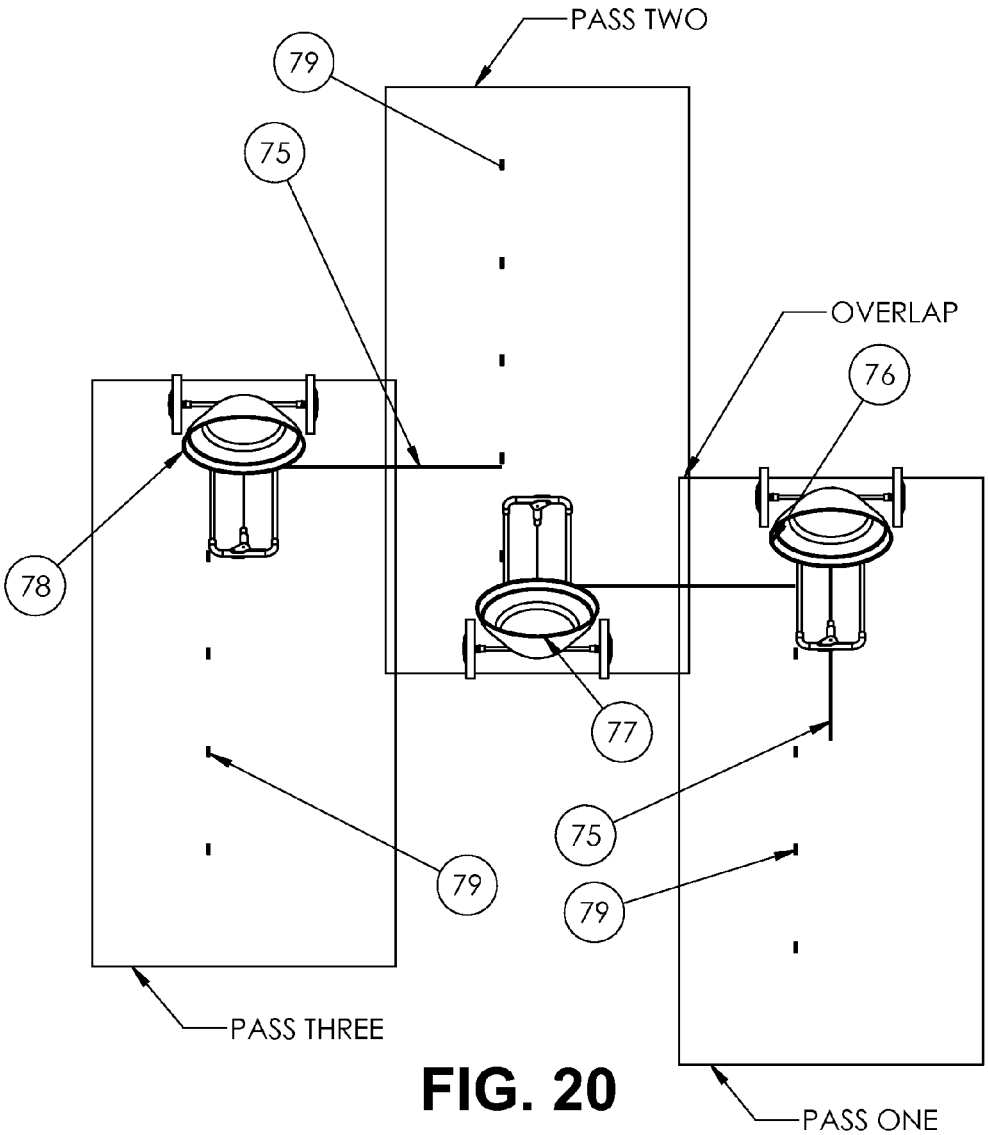
FIG. 20 is a top view of the marking path of a turf marking system of the present disclosure.
Figure 20A:
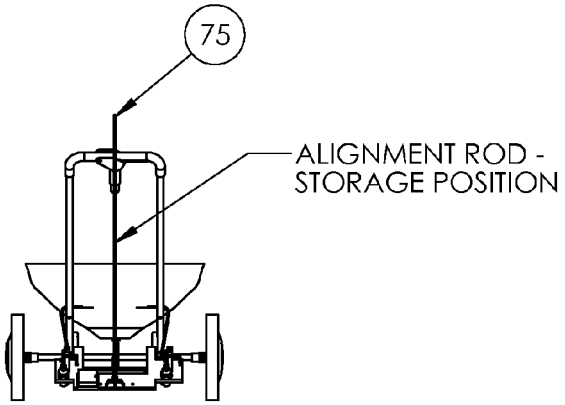
FIG. 20*a* is a rear view of a temporary turf marking system of the present disclosure.

FIG. 20 illustrates how an operator can align spreader operating paths, using spreaders similar to the embodiment disclosed in FIGS. 18 and 19 above. Spreaders 76, 77 and 78, as illustrated, are broadcast-style spreaders similar to spreader 70 discussed above, however, spreaders 76, 77 and 78 include the same foam dispensing system 24 (more clearly seen in FIG. 20*a*), shown in FIG. 10, including a similar dispenser actuator and reservoir. Spreaders 76, 77 and 78 can be operated to ensure that there is a slight overlap of the material or fertilizer from each pass. When spreader 76 drops fertilizer, there is a foam trail 79 provided by a corresponding foam dispenser. On the return pass by spreader 77, the operator can line up the end of the alignment rod 75 with the foam trail 79 from the corresponding foam dispenser. This alignment can provide an overlap. On the next return pass, the operator again uses the end of the alignment rod 75 of the spreader 78 to align with the foam trail 79 of the corresponding dispenser, providing another slight overlap.

Another embodiment of the current disclosure includes using one foam dispenser and enable that dispenser move from one side to the other side using a mechanism configured to facilitate the foam dispenser to translate back and forth along the spreader.

Figure 21:
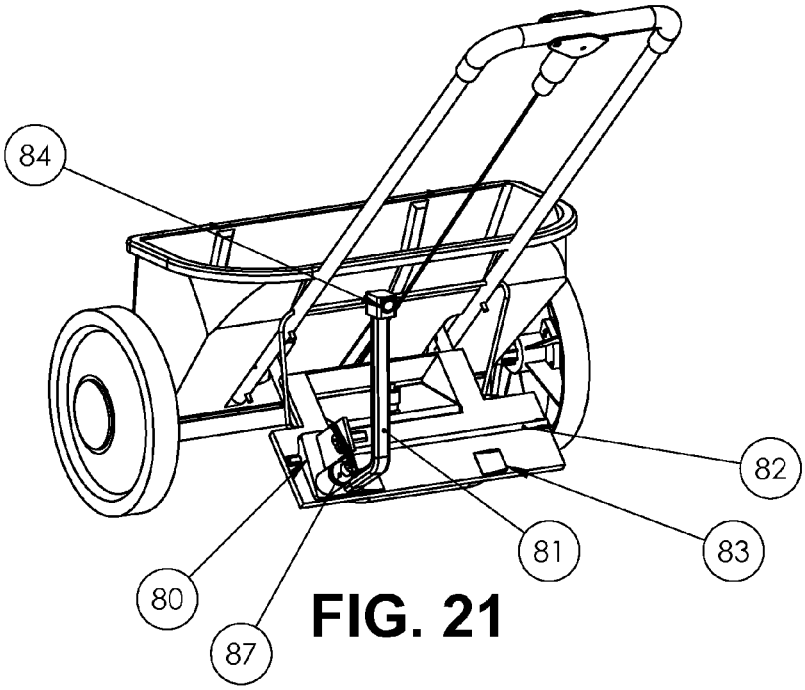
FIG. 21 is perspective view of a temporary turf marking system of the present disclosure having a foam dispensing system in a first position.
Figure 22:
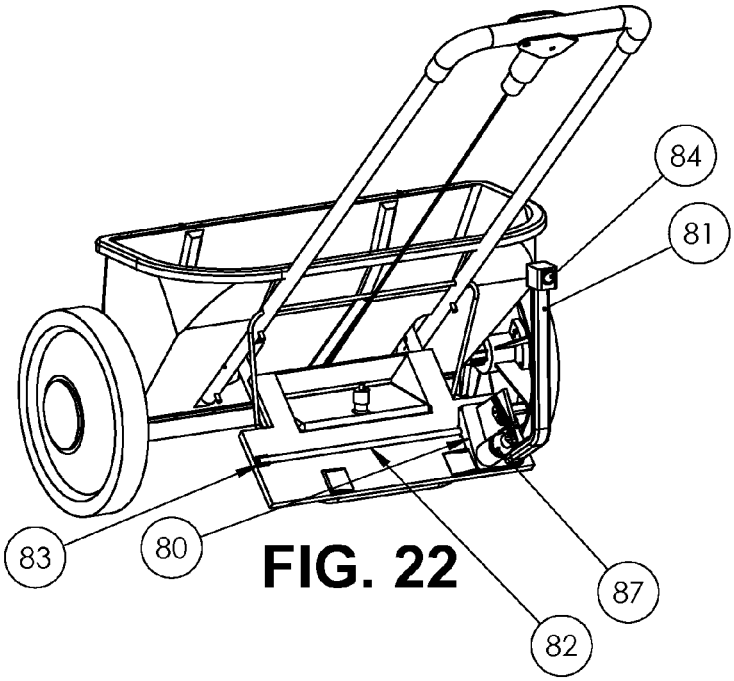
FIG. 22 is perspective view of the temporary turf marking system of FIG. 21, having a foam dispensing system in a second position.
Figure 23:
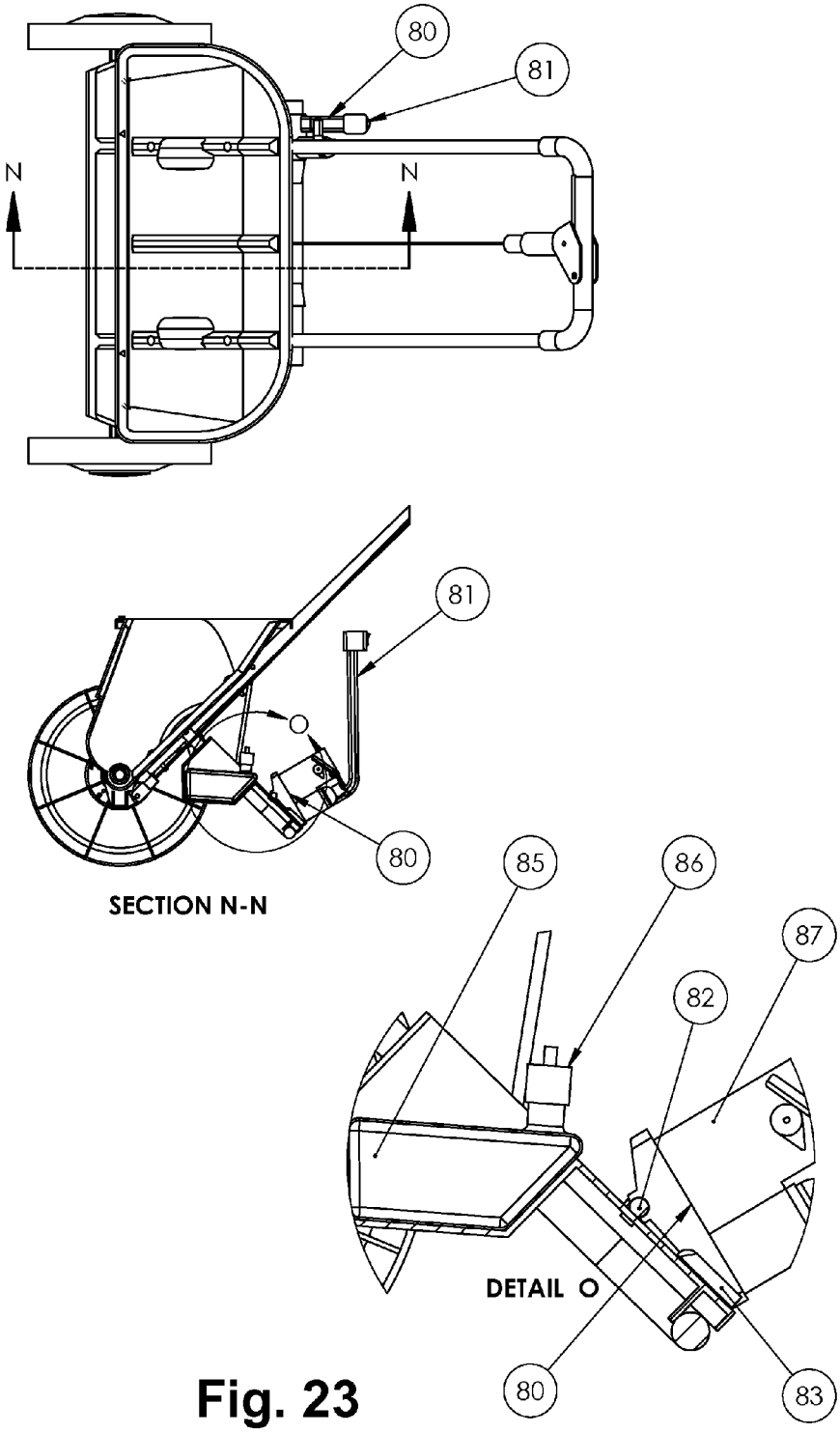
FIG. 23 includes multiple views of the temporary turf marking system of FIG. 21.

FIGS. 21-23 disclose another embodiment of the present disclosure that includes a shuttle 80 fixed to a spreader. In FIG. 21 the shuttle 80 is positioned in a first location on the left side of the spreader. FIG. 22 illustrates the shuttle 80 positioned in a second location on the right side of the spreader. The shuttle 80 contains foam dispensing system 87, similar to the foam dispensing system disclosed in FIGS. 18 and 19, where the electric motor rotates a cam which engages a cam follower to activate a foam dispenser.

The shuttle 80 also includes a handle 81 which contains a power source for the motor and an on-off switch 84 which controls power to the motor. The spreader includes a mounting platform, upon which the shuttle 80 is mounted, that includes a pair of mechanical stops 83, one on each of the left and right sides of the spreader. The purpose of the stops 83 is to provide a mechanical stop for the shuttle 80 to maintain a desired and predetermined position on either the left side or on the right side of the spreader. A shuttle rail 82 is also mounted on the mounting platform and is formed as a round linear shaft. The shuttle rail is used as a track to allow the shuttle 82 to translate from the right side and left side positions. The shuttle also enables a user to keep the foam trail out of the walking path of the user, preventing the user from inadvertently walking through the foam trail and causing the foam trail to prematurely dissipate or disappear.

The shuttle 80 includes a circular bearing surface that engages with and rides on the shuttle rail 82. The bearing surface does extend around the entire shuttle rail 82, but goes beyond center to lock the shuttle onto the shuttle rail 82.

FIG. 23 also includes a top view of the spreader. A cross-section view N-N is taken from the top view of the spreader and the resulting section is shown in the Section N-N view. The shuttle 87 can both rotate and slide on the shuttle rail 82. The center of gravity of the shuttle 80 forces the shuttle 80 to rotate downward and against the mounting plate, which provides multiple benefits.

The first benefit of the shuttle's 80 rotatability is that the shuttle 80 rotates down beyond the surface of the mechanical stop 83, which can prevent the shuttle 80 from moving from beyond the desired locked position. When the shuttle 80 is then moved by the operator to the opposite side, the operator lifts the handle 81, rotating the shuttle 80 above the mechanical stop 83 and then the shuttle 80 can be translated to the opposite end by sliding along the shuttle rail 82.

As discussed above, the reservoir 85 for the foam solution and with a corresponding cap 86 for the reservoir 85 is similar to the embodiments discussed above, but particularly similar to the embodiment disclosed in FIGS. 18 and 19. The tube from the cap 86 to the foam dispensing system 87 is not shown.

Figure 24:
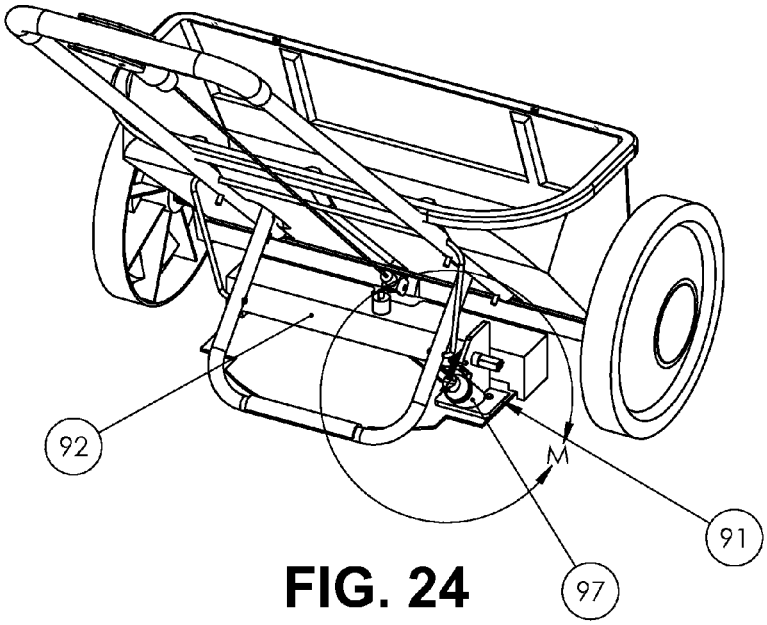
FIG. 24 is perspective view of another temporary turf marking system of the present disclosure.
Figure 25:
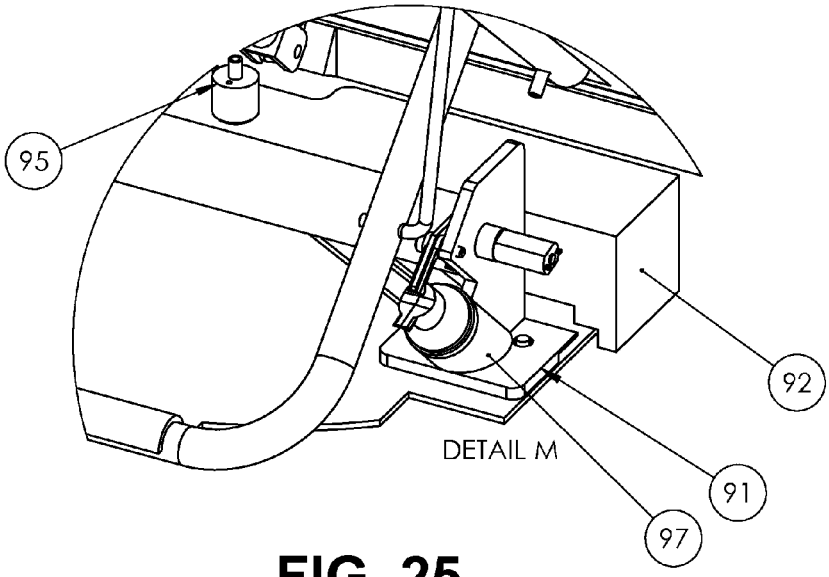
FIG. 25 is a zoomed-in view of the temporary turf marking system of FIG. 24.
Figure 26:
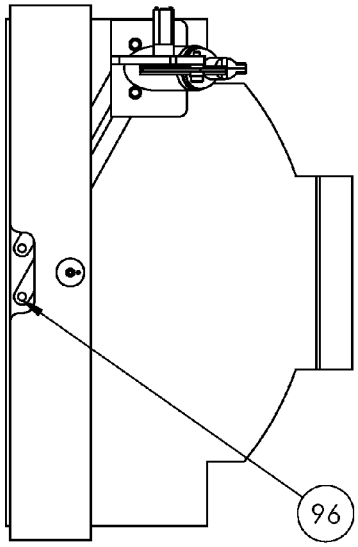
FIG. 26 includes multiple views of the foam dispensing system of the temporary turf marking system of FIG. 24.
Figure 26:
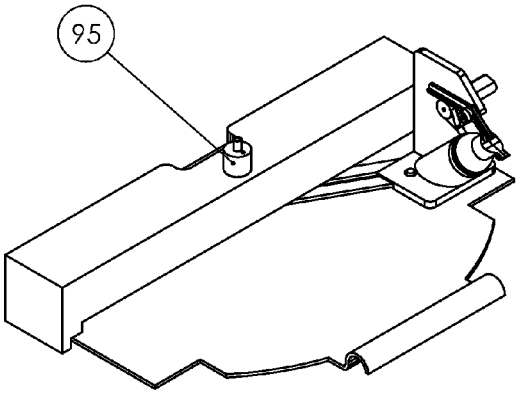
Figure 26:
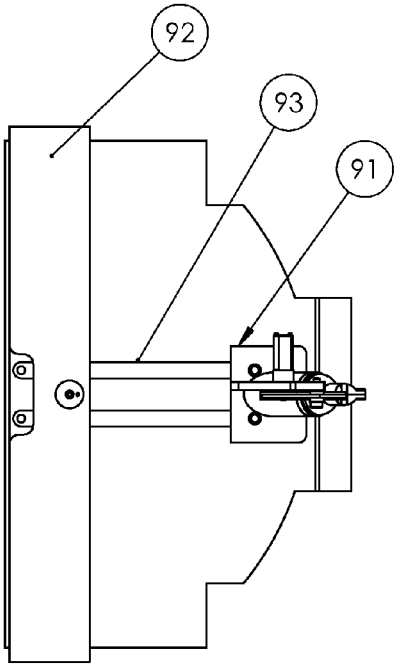
Figure 26:
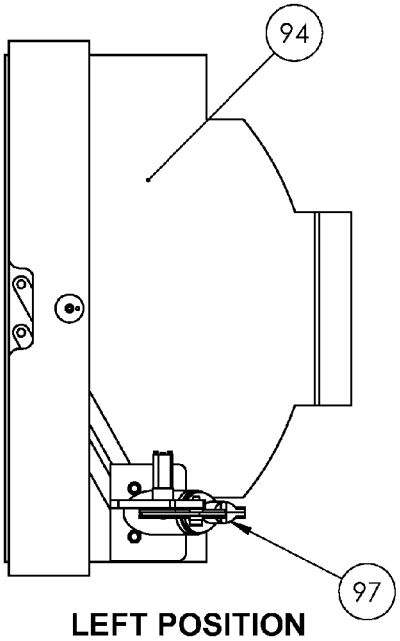

FIGS. 24-26 disclose another embodiment of the current disclosure. Similar to the embodiment disclosed in FIGS. 21-23, the embodiment disclosed in FIGS. 24-26 include a foam dispensing system 91 having only a single foam dispenser 97. The foam dispenser 97 can be moved from a first or left position, to a second or right position using a crank system which includes a pair of parallel arms 96.

Moving, or cranking, one of the pair of arms 96 can in turn move the foam dispensing system 91 which is attached to the pair of arms 96. By using a parallelogram 93 (composed of the pair of arms 96) to control the movement of the foam dispensing system 91, the dispensing of the foam can always occur in the desired direction of the spreader path. A single arm 96 can also be used to rotate the foam dispensing system 91.

The velocity of the foam as it is dispensed from the foam dispenser 97 can alter the placement and deposition of the foam on the turf or grass, it becomes harder to facilitate the correct overlap for each pass. However, a foam dispenser could be used that discharges foam at an angle that is perpendicular to the turf or grass allowing the foam trail to be in line with the fertilizer or material being spread, regardless of the velocity of the foam as it is dispensed from the foam dispenser 97.

A reservoir 92 can contain foam solution to be used by the foam dispenser 97. The reservoir 92 can also be refillable, which can allow a user to refill the reservoir 92 with foam solution at any desired time. The isometric view shows that there is a gap underneath the reservoir 92 allowing for the pair of arms 96 to move, unimpeded from side to side. A cap 95 is also provided for the reservoir 92. The tube connection from the foam dispenser 97 to the cap 95 is not shown.

A support bracket 94 is used to fix the foam dispensing system 91 to the spreader. The structural shape of the support bracket 94 can configured to accommodate various sizes and styles of material spreaders. The support bracket 94 is mounted so that it is substantially horizontal to the turf or grass and can swing underneath a stand for the spreader as shown in FIG. 24. The rear portion of the support bracket 94 can be mounted directly to the stand of the spreader.

It is to be understood that the above-described arrangements are only illustrative of the application of the principles of the present disclosure. Numerous modifications and alternative arrangements may be devised by those skilled in the art without departing from the spirit and scope of the present disclosure are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed:

1. An automated grass marking system comprising:

a manual push spreader;

a handle fixed to the manual push spreader;

at least two wheels, rotatably fixed to the manual push spreader;

a foam dispenser adjustably fixed to the manual push spreader, wherein the foam dispenser is configured to translate from a first position on a left side of the manual push spreader to a second position on a right side of the manual push spreader;

an automated dispenser actuator which actuates the foam dispenser such that foam is automatically dispensed from the dispenser onto the grass, forming an intermittent foam trail; and a switch connected to the automated dispenser actuator, wherein the switch controls the power provided to operate the automated dispenser actuator.

2. The automated grass marking system of claim 1, wherein the foam dispenser is refillable.

3. The automated grass marking system of claim 1, wherein the foam dispenser is positioned off-centered with respect to the manual push spreader.

4. The automated grass marking system of claim 3, wherein the foam dispenser is not positioned in a walking path of the manual push spreader.

5. The automated grass marking system of claim 4, wherein the foam dispenser is not positioned in line with either of the two wheels.

6. The automated grass marking system of claim 1, wherein the foam trail visually dissipates after about 5 minutes from being dispensed from the foam dispenser.

7. The automated grass marking system of claim 1, further comprising:

an alignment rod attached to the manual push spreader and extending from the manual push spreader in a lateral direction, the alignment rod being attached to the manual push spreader such that the alignment rod can pivot with respect to the manual push spreader.

8. The automated grass marking system of claim 1, wherein the foam dispenser is configured to operate at a first location with respect to the manual push spreader and then at a second location with respect to the manual push spreader.

9. The automated grass marking system of claim 1, wherein the manual push spreader is a broadcast or orbital style spreader.

* * * * *